US008770993B2

(12) United States Patent
Gingrich, III et al.

(10) Patent No.: US 8,770,993 B2
(45) Date of Patent: Jul. 8, 2014

(54) CONNECTOR ASSEMBLY WITH POLARITY CORRECTION/PROTECTION

(75) Inventors: Charles R. Gingrich, III, Mechanicsburg, PA (US); Raymond Howard Kohler, Souderton, PA (US); Marek T. Luksic, Dillsburg, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 58 days.

(21) Appl. No.: 13/486,318

(22) Filed: Jun. 1, 2012

(65) Prior Publication Data

US 2013/0323950 A1 Dec. 5, 2013

(51) Int. Cl.
*H01R 25/00* (2006.01)

(52) U.S. Cl.
USPC ..... 439/121; 439/620.09; 439/620.07; 439/620.22

(58) Field of Classification Search
USPC ..... 439/121, 122, 116–118, 620.07, 439/620.09, 620.13, 620.22, 620.24, 620.25
See application file for complete search history.

(56) References Cited

U.S. PATENT DOCUMENTS

| | | | |
|---|---|---|---|
| 3,710,530 | A | 1/1973 | Valtonen |
| 3,898,782 | A | 8/1975 | Donato |
| 4,088,293 | A | 5/1978 | Delmore |
| 4,203,053 | A | 5/1980 | Shepard |
| 4,218,108 | A | 8/1980 | El Mouchi |
| 4,286,419 | A | 9/1981 | Treffers |
| 4,646,212 | A | 2/1987 | Florence |
| 4,736,564 | A | 4/1988 | Gailey |
| 4,831,273 | A | 5/1989 | Ross et al. |
| 5,033,247 | A | 7/1991 | Clunn |
| 5,072,344 | A | 12/1991 | Fabbri |
| 5,334,037 | A | 8/1994 | Gabrius et al. |
| 5,390,461 | A | 2/1995 | Dwyer |
| 5,561,271 | A | 10/1996 | Bruck et al. |
| 5,603,622 | A | 2/1997 | Lin |
| 5,653,412 | A | 8/1997 | Martorano et al. |
| 5,788,518 | A | 8/1998 | Wachter et al. |
| 5,855,485 | A | 1/1999 | Patti |

(Continued)

FOREIGN PATENT DOCUMENTS

| | | | |
|---|---|---|---|
| DE | 10300857 | A1 | 7/2004 |
| DE | 202005020919 | U1 | 12/2006 |

(Continued)

OTHER PUBLICATIONS

Annex to Form PCT/ISA/206 Communication Relating to the Results of the Partial International Search, International Application No. PCT/US2013/040021, International Filing Date May 8, 2013.

*Primary Examiner* — James Harvey

(57) ABSTRACT

A connector assembly for installing a device to a ceiling grid, the ceiling grid having conductors provided therein. The connector assembly includes a housing with contact arms mounted in the housing. Contact portions of the contact arms extend from the housing and are placed in electrical engagement with the conductors when the connector assembly is mated with the ceiling grid. Mounting members extend from the housing. Mounting sections of the mounting members are placed in mechanical engagement with the ceiling grid to provide a mechanical connection between the ceiling grid and the connector assembly. A polarity protection/correction member is provided in the housing. The polarity protection/correction member protects the device from failure or damage when the polarity orientation of the device does not match the polarity orientation of the conductors of the grid.

20 Claims, 7 Drawing Sheets

(56) References Cited

U.S. PATENT DOCUMENTS

| | | | | |
|---|---|---|---|---|
| 6,004,005 | A | 12/1999 | Demshki, Jr. | |
| 6,170,967 | B1 | 1/2001 | Usher et al. | |
| 6,857,883 | B2 | 2/2005 | Tang | |
| 6,884,095 | B1 | 4/2005 | Tsai | |
| 7,351,075 | B1 | 4/2008 | Patterson et al. | |
| 7,654,834 | B1 * | 2/2010 | Mier-Langner et al. | 439/115 |
| 7,997,910 | B2 * | 8/2011 | Myers et al. | 439/121 |
| 8,469,728 | B1 * | 6/2013 | Luksic et al. | 439/116 |
| 2003/0137835 | A1 | 7/2003 | Mier-Langner et al. | |
| 2004/0213003 | A1 | 10/2004 | Lauderdale et al. | |
| 2006/0035518 | A1 | 2/2006 | Hueber | |
| 2006/0272256 | A1 | 12/2006 | Frecska et al. | |
| 2007/0103824 | A1 | 5/2007 | Patterson et al. | |
| 2007/0105415 | A1 * | 5/2007 | Jin et al. | 439/122 |
| 2008/0087464 | A1 | 4/2008 | Patterson et al. | |
| 2008/0090432 | A1 * | 4/2008 | Patterson et al. | 439/121 |
| 2010/0015824 | A1 | 1/2010 | Wang et al. | |
| 2013/0143423 | A1 * | 6/2013 | Luksic et al. | 439/116 |
| 2013/0143434 | A1 * | 6/2013 | Jacobs et al. | 439/527 |
| 2013/0143436 | A1 * | 6/2013 | Brandberg | 439/577 |

FOREIGN PATENT DOCUMENTS

| | | | |
|---|---|---|---|
| FR | 2832748 | A1 | 5/2003 |
| GB | 1 276 020 | A | 6/1972 |
| GB | 1 351 482 | A | 5/1974 |
| GB | 2 140 983 | A | 12/1984 |
| WO | 98/51963 | A2 | 11/1998 |
| WO | 2009 128909 | A1 | 10/2009 |

* cited by examiner

CONNECTOR ASSEMBLY WITH POLARITY CORRECTION/PROTECTION

FIELD OF THE INVENTION

The present invention is directed to an electrical connector assembly which provides the electrical connection between an electrified grid and a device in electrical communication therewith. More particularly, to a connector assembly which provides polarity correction or protection to allow the device to be electrically connected to the grid in any orientation.

BACKGROUND OF THE INVENTION

The electrical grid connecting America's power plants, transmission lines and substations to homes, businesses and factories operate almost entirely within the realm of high voltage alternating current (AC). Yet, an increasing fraction of devices found in those buildings actually operate on low voltage direct current (DC). Those devices include, but are not limited to, digital displays, remote controls, touch-sensitive controls, transmitters, receivers, timers, light emitting diodes (LEDs), audio amplifiers, microprocessors, other digital electronics and virtually all products utilizing rechargeable or disposable batteries.

Installation of devices utilizing low voltage DC has been typically limited to locations in which a pair of wires is routed from the voltage source. Increased versatility in placement and powering of low voltage DC products is desirable. Specifically, there is an increasing desire to have electrical functionality, such as power and signal transmission, in the interior building environment, and specifically in the ceiling environment, without the drawbacks of existing systems.

Commercial building spaces such as offices, laboratories, light manufacturing facilities, health facilities, meeting and banquet hall facilities, educational facilities, common areas in hotels, apartments, retirement homes, retail stores, restaurants and the like are commonly constructed with suspended ceilings. These suspended ceiling installations are ubiquitous, owing to their many recognized benefits. Such ceilings ordinarily comprise a rectangular open grid suspended by wire from a superstructure and tile or panels carried by the grid and enclosing the open spaces between the grid elements.

Many relatively low power devices are now supported on such ceilings and newer electronic devices and appliances are continuously being developed and adopted for mounting on ceilings. The ceiling structure, of course, typically overlies the entire floor space of an occupiable area. This allows the ceiling to support electronic devices where they are needed in the occupied space. Buildings are becoming more intelligent in energy management of space conditioning, lighting, noise control, security, and other applications. The appliances that provide these features including sensors, actuators, transducers, speakers, cameras, recorders, in general, all utilize low voltage DC power.

A conventional grid framework, such as one used in a surface covering system, includes main grid elements intersected by cross grid elements therebetween. The main and cross elements form a grid of polygonal openings into which components such as panels, light fixtures, speakers, motion detectors and the like can be inserted and supported. Known systems that provide electrification to devices, such as lighting components, in conventional framework systems utilize a means of routing discrete wires or cables, principally on an "as needed" point-to-point basis via conduits, cable trays and electrical junctions located in the space behind the grid framework.

These known systems suffer from the drawback that the network of wires required occupy the limited space behind the grid framework and are difficult to service or reconfigure. Moreover, the techniques currently used are limited in that the electricity that is provided is not reasonably accessible from all directions relative to the framework plane. For example, electricity can be easily accessed from a ceiling plenum, but not from areas within or below the plane of the grid framework of a suspended ceiling system. Further, the electrical power levels that are typically available are not safe to work with for those not trained, licensed and/or certified.

In order to reduce the problems described, track systems have been utilized. In such track systems, the tracks typically require wiring and mechanical support from the area behind the grid framework. Connecting devices are positioned between and in electrical communication with the tracks, thereby providing power from the tracks through the connecting devices to devices attached thereto. Existing track systems are typically viewable from the room space and are aesthetically undesirable. Further still, known track systems typically utilize higher voltage AC power and connect to AC powered devices, requiring specialized installation and maintenance.

In an effort to overcome some of the problems with prior systems, internal bus bars have been positioned in the ceiling grid. One such system is described in the documents related to the Emerge Alliance. Such systems provide electrical power through two parallel bus bars embedded within the support rails of a suspended ceiling. However, the bus bar electrical connection points are symmetrically arranged without any visual or mechanical indication of the polarity orientation. If the polarity orientation of the device does not match the polarity orientation of the busbars or rails of the grid, the device may not function or may be damaged. Therefore, devices which are currently connected to the bus bars must be correctly oriented with corresponding electrical polarity or employ some type of separate secondary polarity protection/compensation scheme.

What is needed is a connector which connects the device to the grid and which protects the device from failure or damage when the polarity orientation of the device does not match the polarity orientation of the rails of the grid. In particular, what is needed is a connector which corrects for polarity misalignment and which can be inserted into the grid at any orientation without damaging the device attached thereto, thereby eliminating the need for a separate secondary polarity protection device. The present invention accomplishes these needs and provides additional advantages.

SUMMARY OF THE INVENTION

An exemplary embodiment is directed to a connector which connects a device to a grid and which protects the device from failure or damage when the polarity orientation of the device does not match the polarity orientation of the rails of the grid. Polarity protection includes not allowing the connection to be made between the device and the grid if the polarity orientation does not match. In addition, polarity protection also includes polarity correction which corrects for polarity misalignment and allows the device to be connected to the grid at any orientation without damaging the device attached thereto.

An exemplary embodiment is directed to a connector assembly for installing a device to a ceiling grid, the ceiling grid having conductors provided therein. The connector assembly includes a housing with contact arms mounted in the housing. Contact portions of the contact arms extend from the housing and are placed in electrical engagement with the conductors when the connector assembly is mated with the ceiling grid. Mounting members extend from the housing. Mounting sections of the mounting members are placed in mechanical engagement with the ceiling grid to provide a mechanical connection between the ceiling grid and the connector assembly. A polarity protection member is provided in the housing. The polarity protection member protects the device from failure or damage when the polarity orientation of the device does not match the polarity orientation of the conductors of the grid.

An exemplary embodiment is also directed to a connector assembly for installing a device to a grid having flanges with conductors therein. The connector assembly has a housing with contacts mounted in the housing. The contacts have contact arms which extend from a surface of the housing. Contact portions of the contact arms are positioned to make an electrical connection with the conductors of the grid when the connector assembly is mated with the grid. A first mounting member and a second mounting member are movable between a first position in which grid mounting sections of the first and second mounting members are configured to not engage the flanges of the grid and a second position in which the grid mounting sections of the first and second mounting members are moved away from each other to engage the flanges of the grid to provide a mechanical connection between the grid and the connector assembly. A polarity member is provided. The polarity member protects the device from failure or damage when the polarity orientation of the device does not match the polarity orientation of the conductors of the grid.

An exemplary embodiment is also directed to a connector assembly for installation on a ceiling grid having conductors therein. The connector assembly includes a housing, contact arms, mounting members, a cam member and a polarity member. The contact arms are mounted in the housing and have contact portions. The mounting members are mounted in the housing and have grid mounting sections. The cam member is provided in the housing and is movable between a first position and a second position. The polarity member protects the device from failure or damage when the polarity orientation of the device does not match the polarity orientation of the conductors of the grid. As the cam member is moved from the first position to the second position, the cam member biases the contact portions of the contact arms into electrical engagement with the conductors of the ceiling grid and biases the grid mounting sections of the mounting members mechanical engagement with the ceiling grid to provide a mechanical connection between the ceiling grid and the connector assembly.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to refer to the same or like parts.

DETAILED DESCRIPTION OF THE INVENTION

Figure 1:
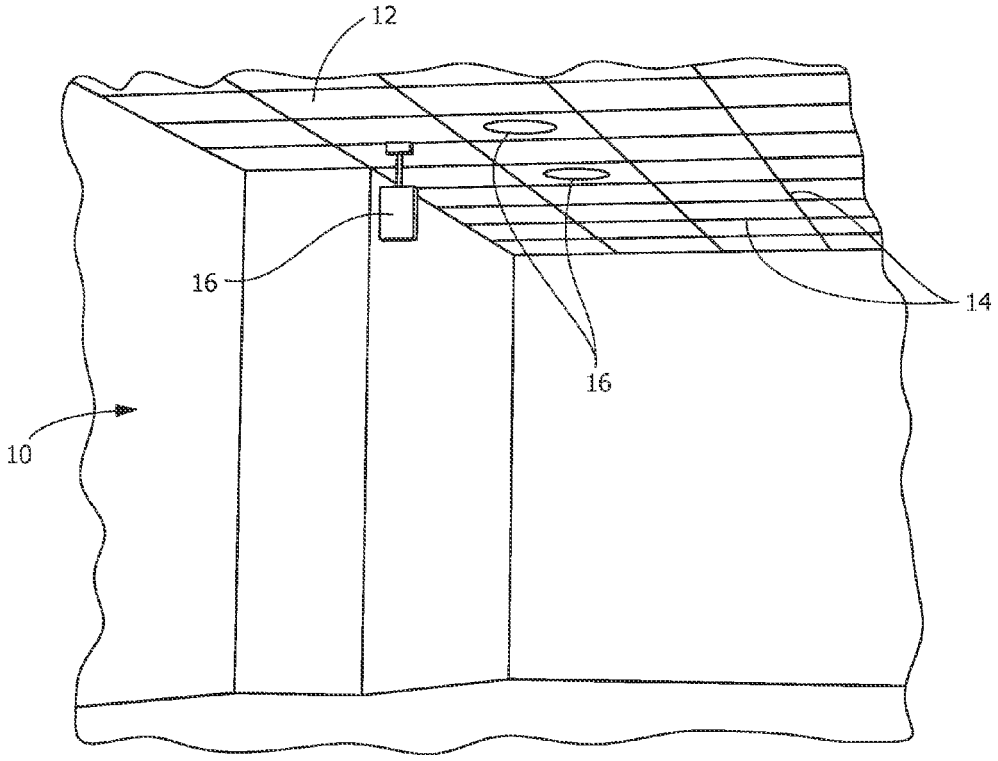
FIG. 1 illustrates a perspective view of a room space having an electrified ceiling according into which a connector can be inserted and electrically engaged.

The present invention will be described more fully hereinafter with reference to the accompanying drawings, in which illustrative embodiments of the invention are shown. In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that spatially relative terms, such as "top", "upper", "lower" and the like, may be used herein for ease of description to describe one element's or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "over" other elements or features would then be oriented "under" the other elements or features. Thus, the exemplary term "over" can encompass both an orientation of over and under. The device may be otherwise oriented (rotated 90 degrees or at other orientations) and the spatially relative descriptors used herein interpreted accordingly.

In addition, the term polarity protection refers to an assembly which protects a device from failure or damage when the polarity orientation of the device does not match the polarity orientation of rails of a grid. Polarity protection includes not allowing the electrical connection to be made between the device and the grid if the polarity orientation does not match. Polarity protection also includes polarity correction which corrects for polarity misalignment and allows the device to be connected to the grid at any orientation without damaging the device attached thereto.

The present invention is directed to connectors for use with an electrified framework or ceiling grid. For illustrative purposes, FIG. 1 shows a room space 10 having a ceiling 12 supported by a ceiling grid framework 14. However, any system having a grid framework, including floors and wall, can utilize the technology of the invention. The ceiling 12 may include decorative tiles, acoustical tiles, insulative tiles, lights, heating ventilation and air conditioning (HVAC) vents, other ceiling elements or covers and combinations thereof. Power for low voltage devices 16 attached to or suspended from the ceiling 12 or framework 14 is provided by the conductive material placed upon the ceiling grid framework 14. Low voltage devices 16, such as, but not limited to, light emitting diode (LED) lights, speakers, smoke or carbon monoxide detectors, wireless access points, still or video cameras, or other low voltage devices, may be utilized with the electrified ceiling.

Figure 2:
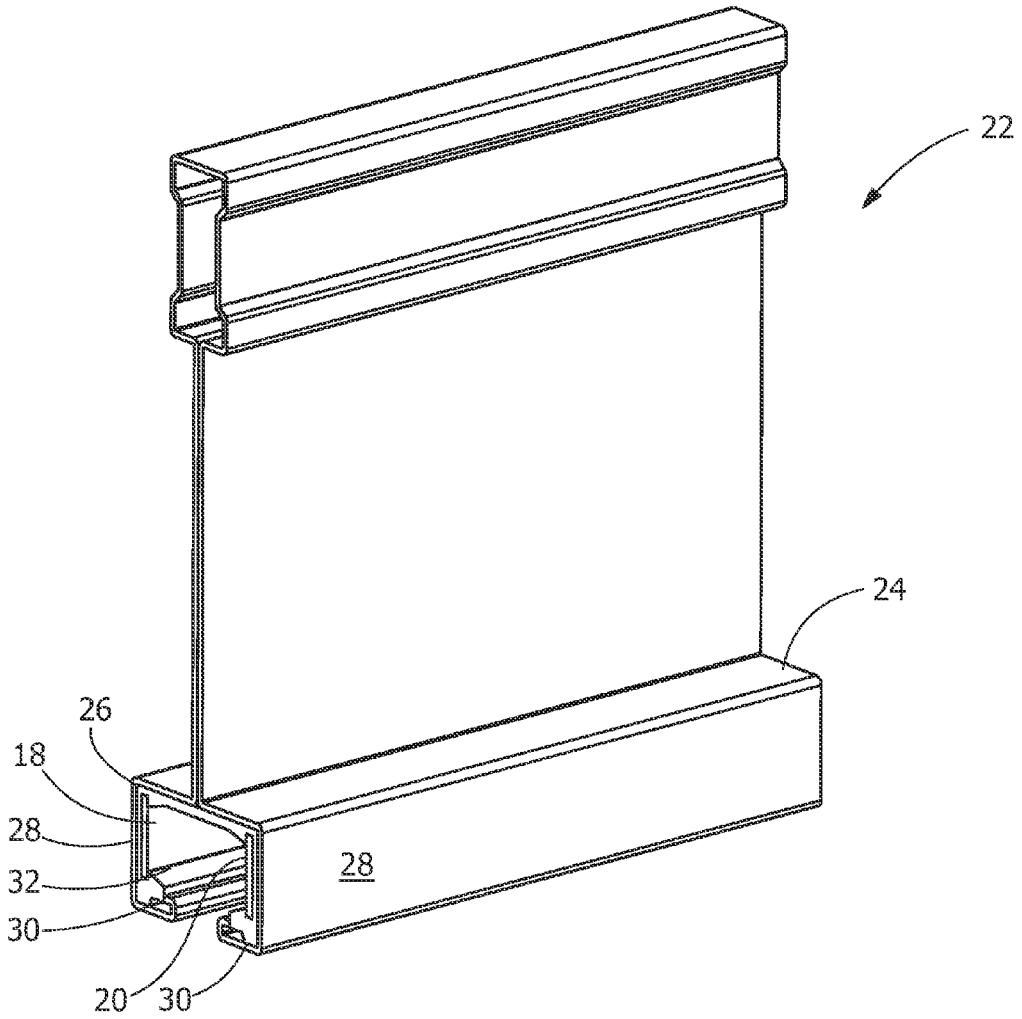
FIG. 2 illustrates a perspective view of a section of an exemplary grid member which can be used in the electrified ceiling of FIG. 1.

In the exemplary embodiment shown, conductive material is disposed on a surface of at least one of the plurality of grid members. In the exemplary embodiment shown in FIG. 2, first and second conductive strips 18 and 20 are disposed on a grid element 22 of the grid framework 14. The conductive strips 18 and 20 have opposite polarity, i.e. one is positive and one is negative. The conductors 18, 20 are housed inside the lower box 24 of the grid element 22. More specifically, in the exemplary embodiment shown, the conventional lower box 24 configuration typically has a base wall 26, a pair of side walls 28 and a pair of flanges 30 that define a slot 32 therebetween. Conductors 18, 20 which are positioned on respective surfaces of the pair of sidewalls 28.

One or more exemplary connectors assemblies 100 (FIG. 3) are provided to electrically connect the devices 16 to the grid elements 22 of the grid framework 14. For example, a connector assembly 100 provides a low voltage electrical connection between the conductors 18, 20 on the grid framework 14 and a device 16 such as a light.

As shown in FIGS. 3 through 9, an exemplary connector assembly 100 for making a low voltage electrical connection between one or more devices 16 and conductors 18, 20 housed inside the lower box 24 of a grid element 22 is provided. The connector assembly 100 provides the electrical interface required and the flexibility of attaching the connector assembly 100 to the box 24 of a respective grid element 22 at any position along the length of the grid box 24. In addition, the connector assembly 100 provides a robust mechanical connection with the grid element 22 and an electrical connection between the conductors 18, 20 and various devices 16.

Figure 6:
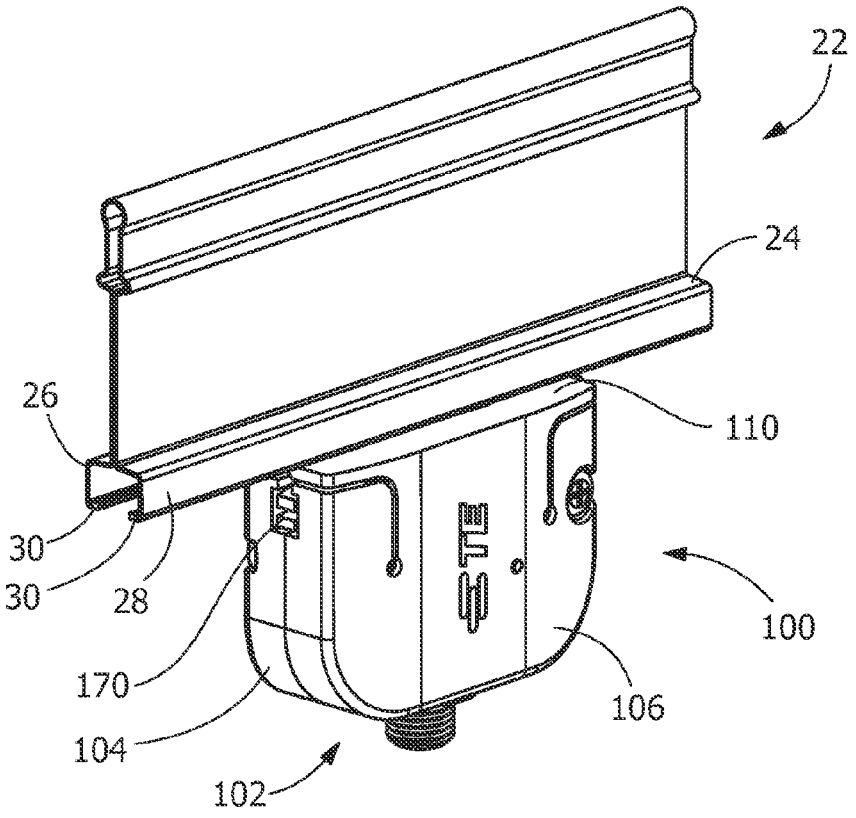
FIG. 6 illustrates a perspective view of the exemplary connector assembly as the connector is fully inserted into the exemplary grid member.

Referring to FIG. 6, the exemplary connector assembly 100 includes a connector housing 102 comprising two halves 104 and 106. Each housing is molded from plastic or other material having the strength and electrically insulative properties required. Each connector half 104, 106 has a top surface 110 which is configured to abut against or be positioned proximate a respective flange 30 of the grid element 22, as will be more fully described.

Figure 3:
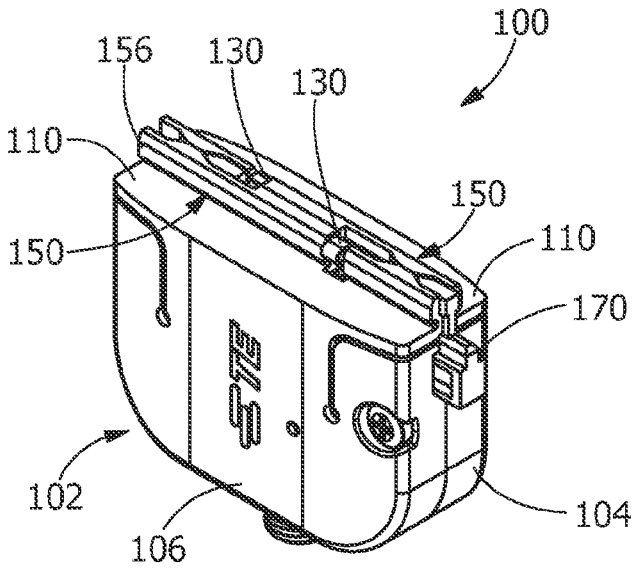
FIG. 3 illustrates a perspective view of an exemplary connector assembly according to an exemplary embodiment.
Figure 4:
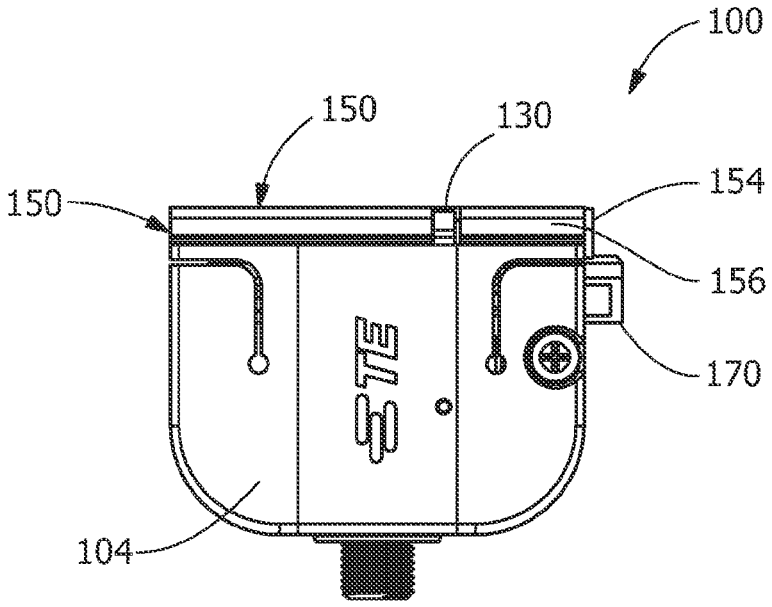
FIG. 4 illustrates a front elevational view of the exemplary connector of FIG. 3.
Figure 5:
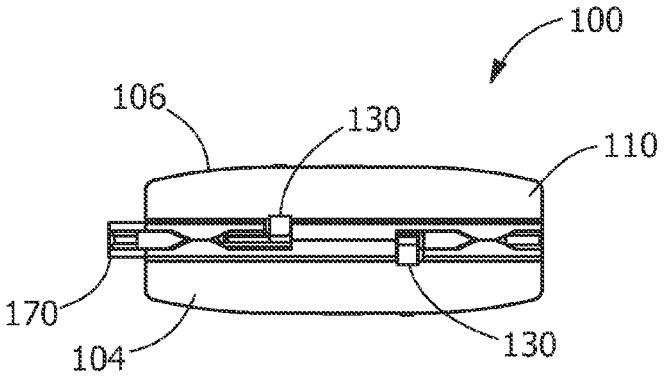
FIG. 5 illustrates a top view of the exemplary connector assembly of FIG. 3.
Figure 7:
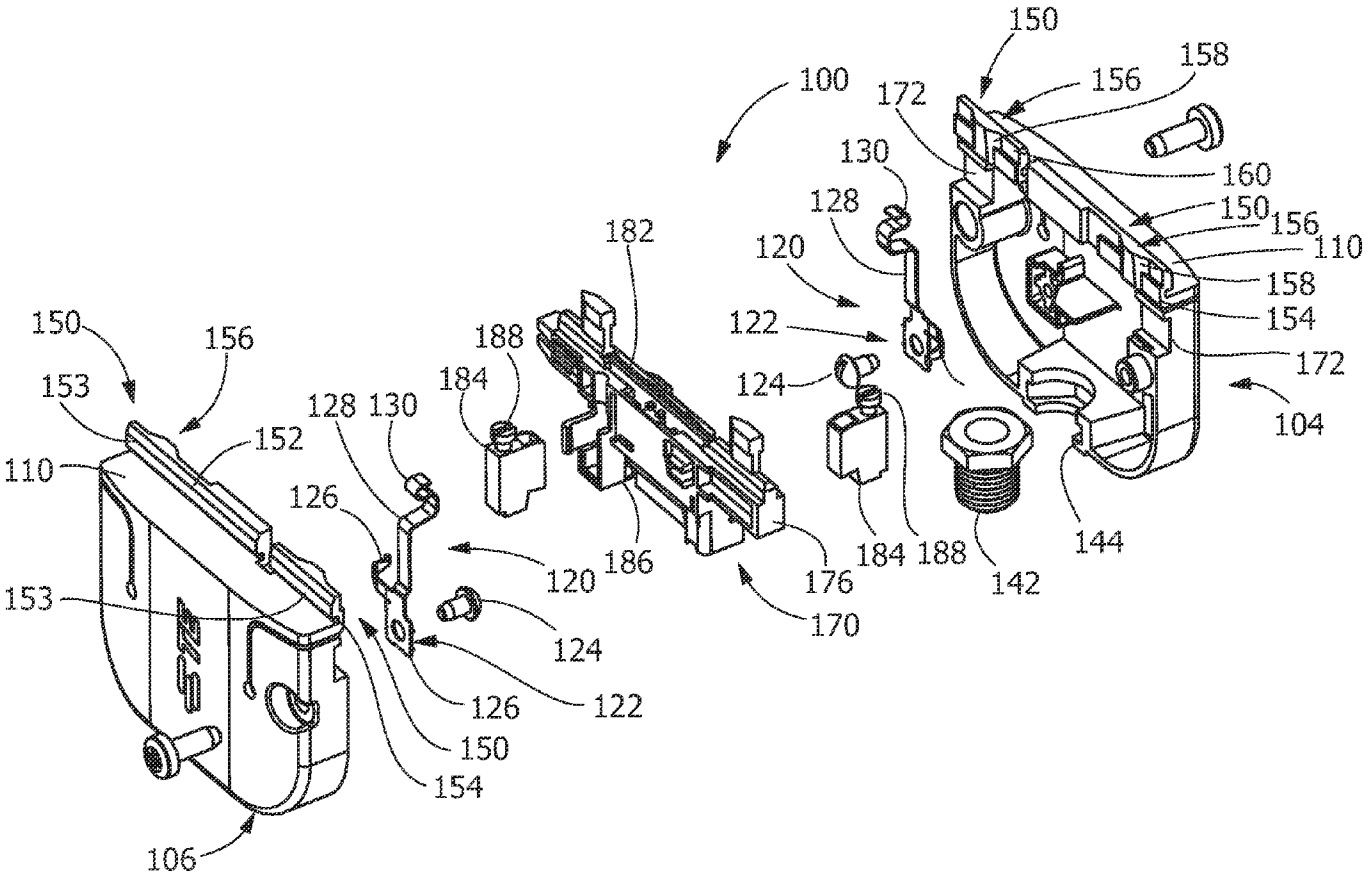
FIG. 7 illustrates an exploded view of the exemplary connector assembly.

A contact 120 is secured in each contact half 104, 106. As best shown in FIG. 7, each contact 120 has a mounting portion 122 which has an contact projection 124 positioned thereon. The contact projection 124 may be, for example, a screw which maintains the mounting portion 122 in position. Contact arm 126 extends from the mounting portion 122. A contact arms 126 and 128 extends from the mounting portion 122. The contact arm 128 has a contact portion 130 which is between mounting members 150, as best shown in FIG. 3. The contact arm 128 and the contact portion 130 are configured to have resilient characteristics. In the exemplary embodiment shown, the contact portions 130 are positioned offset from the midpoint of the longitudinal axis of each top surface 110. Other positioning of the contact portions 130 can be used without departing from the scope of the invention.

A device mounting hardware 142, which in the exemplary embodiment is in the form of a hex nut with threads, is mounted in the housing 102. Recesses 144 in each half 104, 106 maintain the mounting hardware 142 in position. In one exemplary embodiment, two wires may be attached to connections on the cam member 170 and routed through the mounting hardware 142 to a respective external low voltage device 16.

Figure 8:
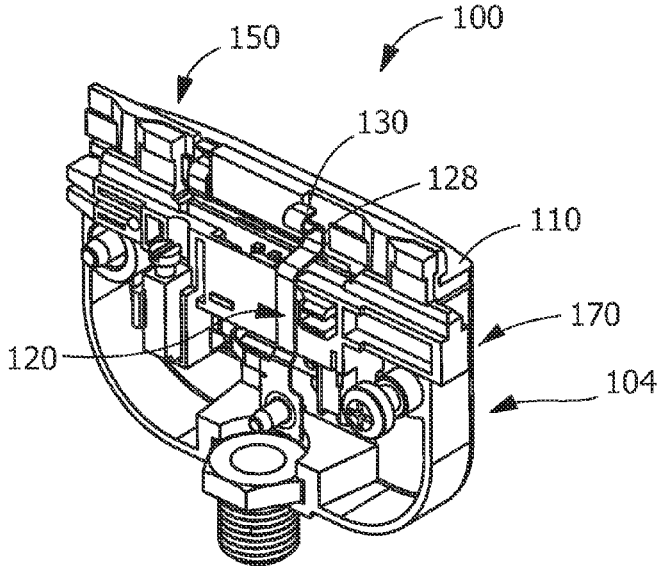
FIG. 8 illustrates a perspective cross-sectional view of the assembled exemplary connector assembly.
Figure 9:
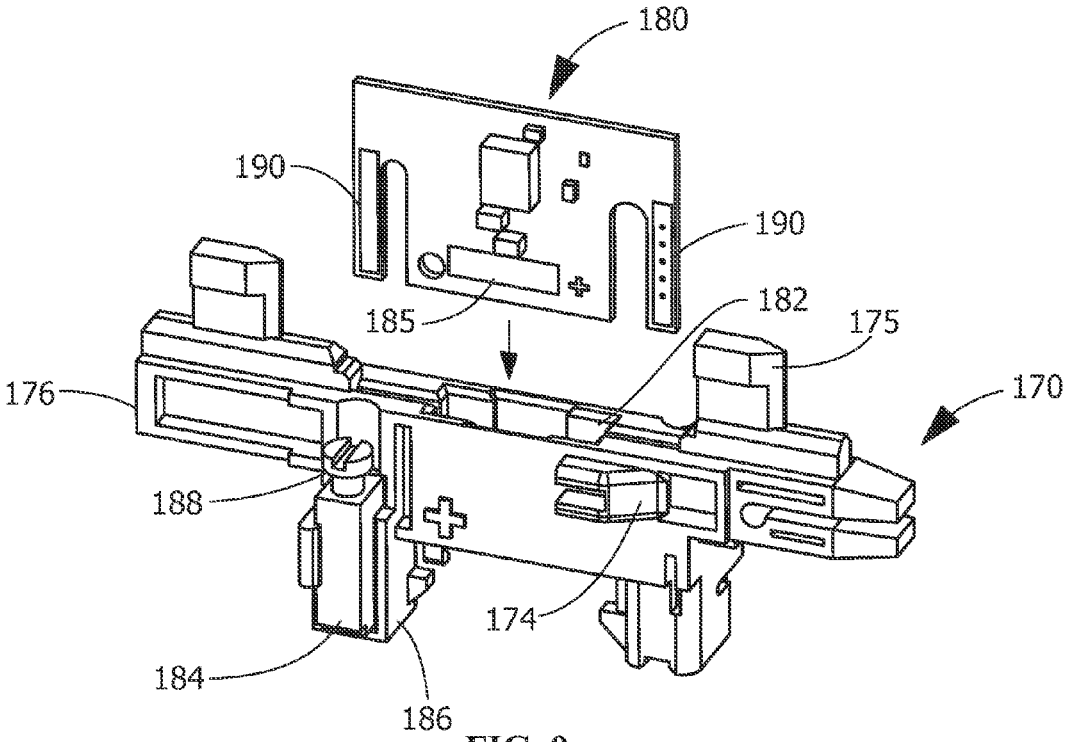
FIG. 9 illustrates a perspective view of an exemplary cam member with a substrate exploded therefrom.

Referring to FIGS. 7 and 8, mounting members 150 extend from the top of the respective housing halves 104, 106. Each mounting member 150 has a grid mounting section 152, a pivot section 154, and a cam engagement section 156. In the exemplary embodiment shown, the mounting members 150 are integrally molded with the housing halves 104, 106. However, other types of mounting members may be used without departing from the scope of the invention, such as, but not limited to, the mounting members disclosed in co-pending U.S. patent application Ser. No. 13/309,605, which is hereby incorporated by reference in its entirety.

The grid mounting sections 152 have projections 153 which cooperate with the top surface of the flanges 30 to better maintain the mounting members 150 in cooperation with the flanges 30, as will be more fully described. The cam engagement sections 156 have ramped surfaces 158 which are provided between first surface 160 and second surfaces 162.

A cam member 170 is provided in the housing 102. In the exemplary embodiment shown, the cam member 170 extends through openings 172 provided at either end of the housing 102. The cam member 170 has camming surfaces 174, 175 positioned on opposed side surface thereof. In the exemplary embodiment, the camming surfaces 174 are projections which have a sloped surface which cooperate with the contact arm 128 of the contact 120, but various other configurations may be used. In the exemplary embodiment, the camming surfaces 175 have a sloped surfaces to cooperate with the cam engagement sections 156, but various other configurations may be used. Operator engagement areas 176 are provided proximate the ends of the cam member 170. Other configurations of the cam member 170 may be used without departing from the scope of the invention.

The cam member 170 has a substrate or circuit board 180 mounted in a circuit board or substrate receiving area 182, which may be, but not limited to a cavity or opening. The cam member 170 also has wire connectors 184 mounted on wire connector receiving portions 186. In the embodiment shown, the wire connectors 184 include screws 188 which cooperate with the wires to terminate the wires to the wire connector receiving portions 186. The wire connectors 184 provide electrical engagement of wires with pads 190 of the circuit board 180 when the circuit board 180 is properly positioned in the circuit board receiving area 182. The electrical engagement is made using known technology, such as, but not limited to wires, conductive traces or the like.

Contact pads 185 are provided on the circuit board 180 to cooperate with the contact projections 126 of the contacts 120, whereby the contact projections 126 engage and are placed in electrical connection with the contact pads 185 of the circuit board 180 when the circuit board 180 is properly positioned in the circuit board receiving area 182. The electrical engagement is made using known technology, such as, but not limited to wires, conductive traces or the like.

The circuit board 180 has contact pads and various components mounted thereon or therein. The components provided on the circuit board 180 are dependent upon whether polarity protection or polarity correction is to be performed.

The components of the circuit board 180 includes components that automatically protect or correct the polarity, regardless of the orientation in which the device is mounted to the grid. In an exemplary embodiment, for polarity correction, the components include a MOSFET transistor, in which 4 e-switches which perform the polarity correction. In one embodiment, the switches can accommodate 100 watts of power at 4 amps efficiently and operate within acceptable parameters. In order to properly perform the polarity protection, the connections/connector must be reversed if installed improperly. Consequently, each wire from the device must be in communication with 2 switches, such that each wire is capable of connecting to either contact 120.

If the connector assembly 100 is to provide polarity protection, a SMT Schottky diode may be provided. Alternatively a Field Effect Transistor (FET) circuit may be provided. These are but two exemplary examples of the type of polarity protection members or devices which may be incorporated on the printed circuit board 180. An indicator circuit could be designed to light a red LED or the like to indicate to the end user that the polarity is reversed. The cam member 170 or a portion thereof could be molded in a clear material to serve as a dual purpose cam/light pipe for the indicator.

If the connector assembly 100 is to provide polarity correction, various device may be used to provide the polarity correction, including, but not limited to, a Surface Mount Technology (SMT) diode based bridge with silicon rectifier diodes, Schottky diodes or the like. In addition, a single-package SMT four MOSFET H bridge or a dual package complementary N and P channel MOSFET can be used depending upon the requirements of the system.

In a preferred exemplary embodiment, the polarity protection/correction device or member is specified to accommodate the maximum rated current of the circuit.

When installing the connector assembly 100 on a respective grid element 22, the connector assembly 100 is moved toward the grid element 22. As this occurs, the longitudinal axis of the assembly 100 is positioned essentially parallel to the longitudinal axis of the box 24 of the grid element 22. As assembly 100 is moved toward grid element 22, the contact portions 130 of the contacts 120 are inserted between flanges 30 into slot 32 of box 24. Grid mounting sections 152 of mounting members 150 are also inserted between flanges 30 into slot 32 of box 24. Insertion continues until the top surface 110 of the connector assembly 100 is in contiguous relation with the pair of flanges 30 of the box 24 which define the slot, such that the contact portions 130 and mounting sections 152 are properly positioned in the slot 32. Other methods of insuring proper position of the contact portions 130 and mounting sections 152 may be used.

With the assembly 100 properly inserted, an operator or end user engages a respective operator engagement area 176, causing the cam member 170 to be moved from a first position, in which the camming surfaces 174, 175 do not engage the contact arms 128 of the contacts 120 or the cam engagement sections 156 of the mounting members 150, to a second position, in which the camming surfaces 174, 175 do engage the contact arms 128 of the contacts 120 and the cam engagement sections 156 of the mounting members 150. As this movement from the first position to the second position occurs, the camming surfaces 175 engage the cam engagement sections 156 and the camming surfaces 174 engage the contact arms 128, causing the sections 156 and contact arms 128 to be biased outward in a direction toward the sidewalls 28 of the grid element 22.

With the cam member 170 in the second position, the contact portions 130 of the contact arms 128 engage the conductors 18, 20 of the box 24. As the contact arms 128 are resiliently deformable, the contact arms 128 of the contacts 120 will provide sufficient force to maintain a positive electrical connection between the conductors 18, 20 and the contact portions 130. The resiliency of the contact arms 128 also allows the contact arms 128 and contact portions 130 to compensate for any irregularities in the conductors 18, 20. In addition, the engagement sections 152 are biased outward to cooperate or engage with the flanges 30 to prevent the withdrawal of the engagement sections 152 from the slot 32, thereby providing a mechanical interface to maintain the assembly 100 in position relative to the grid element 22. In the exemplary embodiment shown, the projections 153 are configured to be positioned proximate to or in engagement with the upper surfaces of the flanges 30 to provide a secure mechanical connection.

With the assembly 100 properly mounted to the grid element 22, a low voltage electrical device may be mounted to the assembly 100, thereby establishing an electrical connection between the conductors 18, 20 and the low voltage device by means of contact 120. The cooperation of the engagement sections 152 of members 150 with the grid element 22 provide sufficient mechanical support to support the weight of and to allow the low voltage device to hang from the assembly 100 and grid element 22. In order to provide a proper electrical connection between the device 16 and the assembly 100, the appropriate wires of the device are electrically connected to the appropriate contacts or wires of the device to insure for proper polarity therebetween. As an example, the red wire of the device is connected to the pad of the substrate marked with a "+", and the black wire connected to the pad of the substrate marked with a "−". Alternatively, the assembly 100 may pre-assembled with an output cable assembly "whip" that has a red wire and a black wire extending therefrom for connection to the appropriate wires of the device to insure for proper polarity therebetween.

The assembly 100 is designed to hold a low voltage electrical device fixture and carry low voltage current thereto. In alternate exemplary embodiments, a conventional threaded component can be attached at the bottom of the housing 102 to hold a fixture such as a camera or lighting device. In addition, the housing 102 may include miscellaneous conventional fixture mounting hardware such as strain reliefs, nipples, etc. for attaching the low voltage electrical device, such as a pendant light, to the assembly 100. In other exemplary embodiments, the low voltage electrical device may have wires which must be electrically connected to wires or contact pads of the assembly 100. In such applications the wires may be inserted through the mounting hardware 142. The ends of the wires may then be attached by placing them into wire connectors 184 and tightening screws 188. The low voltage electrical device wires are then routed through the fixture mounting hardware.

When the circuit board 180 is mounted or positioned in the circuit board receiving area 182 and the assembly 100 is properly mounted, the current flows through the contacts 120, the components on the circuit board 180 and the wires.

Alternatively, if no circuit board 180 is inserted, the cam member 170 allows the contacts 120 to be in electrical connection with the wires when the assembly 100 is properly mounted. Thus, the polarity protection/correction function is not present, allowing the assembly 100 to be used in the same manner as previous connector assemblies.

If the device is no longer needed, the device may be removed from the assembly 100. The assembly 100 may then be removed from the grid element 22. Alternatively, the assembly 100 may be removed from the grid element with the device still attached. In order to remove the assembly 100, the cam member 170 is moved from the second position back to the first position. As this occurs, the contacts 120 and the mounting members 150 return to their initial or unbiased positions, thereby causing the engagement sections 152 and contact portions 130 to move away from the sidewalls 28 of the grid element 22 and disengage from the flanges 30. This allows for the withdrawal of the engagement sections 152 and the contact portions 130 from the slot 32, insuring that the assembly 100 can be both electrically and mechanically removed from the grid element 22.

Figure 11:
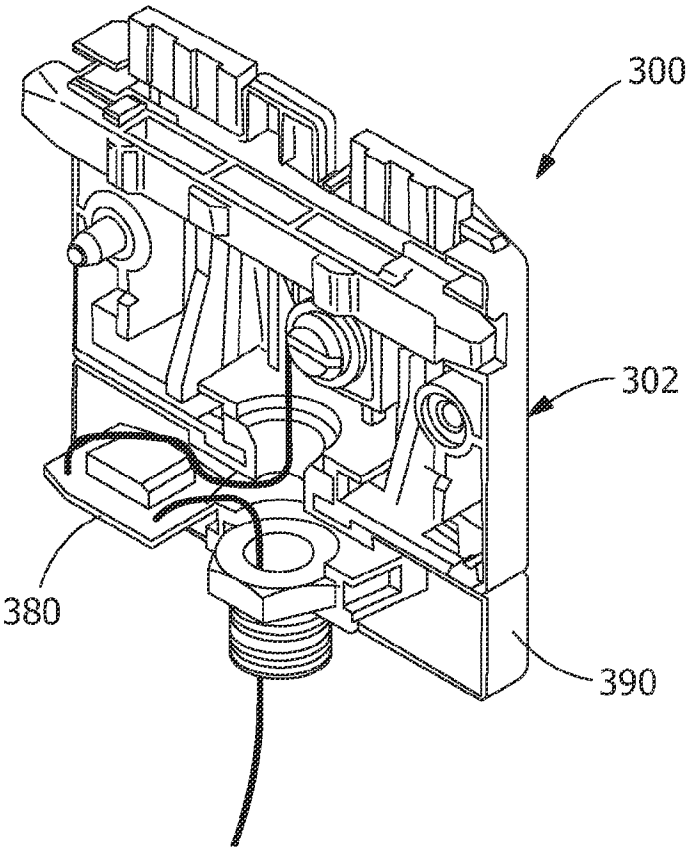
FIG. 11 illustrates a second alternate exemplary embodiment of the invention.
Figure 10:
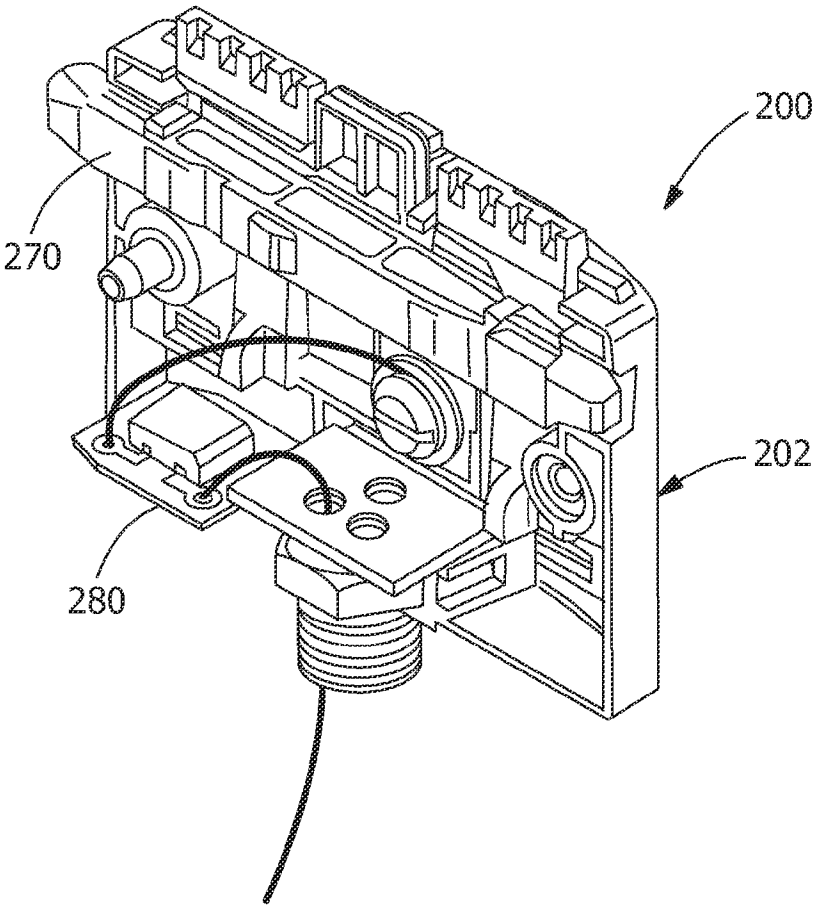
FIG. 10 illustrates a first alternate exemplary embodiment of the invention.

Other embodiments of the connector assembly with a polarity protection/correction member may be used without departing from the scope of the invention. For example, as illustrated in the exemplary embodiment of FIG. 10, a printed circuit board or other polarity protection/correction member 280 may be positioned in the housing 202 of the connector assembly 200, but not be mounted in the cam member 270. Another exemplary embodiment shown in FIG. 11 illustrates that an additional module 390 may be mounted to the housing 302 of the connector assembly 300. The additional module 390 includes the printed circuit board or other polarity protection/correction member 380.

There are various advantages associated with the type of assembly described herein and represented by the exemplary embodiment of assembly 100. As the assembly 100 and grid 14 are not keyed, the polarity orientation of the device may not match the polarity orientation of the busbars or rails of the grid, causing the device to be damaged or not function. The invention provides for polarity protection/correction to protect the device from failure or damage when the polarity orientation of the device does not match the polarity orientation of the rails of the grid, thereby eliminating the need for a separate secondary polarity protection device. The present invention accomplishes these needs and provides additional advantages.

The removability and replaceability of the circuit board allows the function of the assembly 100 to be removed or enhanced as needed. With the insertion of different circuit boards, the performance may be improved and new more valuable functions can be integrated into the assemblies by simply changing the board. Mass customization of the connector is enabled allowing new functions to be installed at the very end of production or in the field.

Installation of the assembly onto the grid is intuitive and can be accomplished by trained installers and consumers alike. In addition, as the installation and removal of the connector does not damage the connector or the grid, the connector may be used over many cycles and for various devices.

As the projection and contacts are used to provide the electrical connection, the contacts can be configured to optimize the electrical connection to the conductors of the grid element. This allows the contacts to compensate for tolerances associated with the grid box. Once inserted into the grid element, the contacts are concealed and protected from damage.

With the engagement sections properly cammed into position, the engagement sections provide the mechanical connection required to maintain the assembly and device connected thereto in position. This allows the mechanical load on the contacts to be minimized, thereby allowing less material to be used for the contacts.

While the invention has been described with reference to a preferred exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A connector assembly for installing a device to a ceiling grid, the ceiling grid having conductors provided therein, the connector assembly comprising:

a housing;

contact arms mounted in the housing, contact portions of the contact arms extend from the housing and are placed in electrical engagement with the conductors when the connector assembly is mated with the ceiling grid;

mounting members extending from the housing, mounting sections of the mounting members are placed in mechanical engagement with the ceiling grid to provide a mechanical connection between the ceiling grid and the connector assembly;

a polarity protection member positioned in the housing, the polarity protection member protects the device from failure or damage when the polarity orientation of the device does not match the polarity orientation of the conductors of the grid.

2. The connector assembly as recited in claim 1, wherein a cam member provided in the housing, the cam member being movable between a first position, in which the cam member allows the contact arms to be in their first position and the mounting members to be in their first position, and a second position, in which the cam member causes the contact arms and mounting members to be biased to their respective second positions.

3. The connector assembly as recited in claim 2, wherein the cam member has a substrate mounted in a substrate receiving area, the polarity protection member is positioned on the substrate.

4. The connector assembly as recited in claim 3, wherein, the cam member has wire connectors mounted on wire connector receiving portions, the wire connectors cooperate with wires extending from the device to terminate the wires to the wire connectors, the wire connectors provide electrical engagement of the wires to pads on the substrate when the substrate is properly positioned in the substrate receiving area.

5. The connector assembly as recited in claim 3, wherein contact pads are provided on the substrate to cooperate with contact projections of the contacts, whereby as the cam member is moved to a second position, the contact projections engage and are placed in electrical connection with the contact pads.

6. The connector assembly as recited in claim 3, wherein the substrate is a circuit board.

7. The connector assembly as recited in claim 3, wherein the polarity protection member provides polarity correction between the conductors of the ceiling grid and the device.

8. The connector assembly as recited in claim 7, wherein four switches provide the polarity correction, with two switches provided in electrical communication with each wire which extends from the device.

9. The connector assembly as recited in claim 6, wherein the polarity protection is provided by a surface mount technology Schottky diode.

10. The connector assembly as recited in claim 6, wherein the polarity protection is provided by a field effect transistor circuit.

11. The connector assembly as recited in claim 1, wherein an indicator circuit is provided to indicate to the end user that the polarity is reversed.

12. The connector assembly as recited in claim 2, wherein an indicator circuit is provided to indicate to the end user that the polarity is reversed, a portion of the cam member is made of a clear material to serve as a light pipe for the indicator circuit.

13. The connector assembly as recited in claim 7, wherein the polarity protection member is a surface mount technology diode based bridge with silicon rectifier diodes.

14. The connector assembly as recited in claim 7, wherein the polarity protection member is a single-package surface mount technology four MOSFET H bridge.

15. The connector assembly as recited in claim 7, wherein the polarity protection member is dual package complementary N and P channel MOSFET.

16. A connector assembly for installing a device to a grid having flanges with conductors therein, the connector assembly comprising:

a housing with contacts mounted in the housing, the contacts having contact arms which extend from a surface of the housing, contact portions of the contact arms positioned to make an electrical connection with the conductors of the grid when the connector assembly is mated with the grid;

a first mounting member and a second mounting member movable between a first position in which grid mounting sections of the first and second mounting members are configured to not engage the flanges of the grid and a second position in which the grid mounting sections of the first and second mounting members are moved away from each other to engage the flanges of the grid to provide a mechanical connection between the grid and the connector assembly;

a polarity member, the polarity member protects the device from failure or damage when the polarity orientation of the device does not match the polarity orientation of the conductors of the grid.

17. The connector assembly as recited in claim 16, wherein the polarity member is a circuit provided on a substrate and provides polarity protection between the conductors or the ceiling grid and the device.

18. The connector assembly as recited in claim 3, wherein the polarity member is circuit provided on a substrate and provides polarity correction between the conductors or the ceiling grid and the device.

19. A connector assembly for installation on a ceiling grid having conductors therein, the connector assembly comprising:

a housing;

contact arms mounted in the housing, the contact arms having contact portions;

mounting members mounted in the housing, the mounting members having grid mounting sections;

a cam member provided in the housing, the cam member being movable between a first position and a second position;

a polarity member, the polarity member protects the device from failure or damage when the polarity orientation of the device does not match the polarity orientation of the conductors of the grid;

wherein as the cam member is moved from the first position to the second position, the cam member biases the contact portions of the contact arms into electrical engagement with the conductors of the ceiling grid and biases the grid mounting sections of the mounting members mechanical engagement with the ceiling grid to provide a mechanical connection between the ceiling grid and the connector assembly.

20. The connector assembly as recited in claim 19, wherein the polarity member is circuit provided on a substrate mounted in an opening of the cam member and provides polarity correction between the conductors or the ceiling grid and the device.

* * * * *